US008887957B2

(12) United States Patent
Robinson

(10) Patent No.: US 8,887,957 B2
(45) Date of Patent: Nov. 18, 2014

(54) DEVICE FOR OPENING AND DISPENSING CONTENTS OF PACKETS

(71) Applicant: John Robinson, Smithfield, RI (US)

(72) Inventor: John Robinson, Smithfield, RI (US)

( * ) Notice: Subject to any disclaimer, the term of this patent is extended or adjusted under 35 U.S.C. 154(b) by 0 days.

(21) Appl. No.: 13/903,456

(22) Filed: May 28, 2013

(65) Prior Publication Data

US 2014/0008387 A1 Jan. 9, 2014

Related U.S. Application Data

(60) Provisional application No. 61/668,586, filed on Jul. 6, 2012.

(51) Int. Cl.

| | |
|---|---|
| ***B67D 1/00*** | (2006.01) |
| ***B65D 35/28*** | (2006.01) |
| ***B65D 77/06*** | (2006.01) |

(52) U.S. Cl.

CPC ..... *B65D 35/28* (2013.01); *B65D 2583/005* (2013.01); *B65D 77/06* (2013.01)

USPC ..... 222/82; 222/106

(58) Field of Classification Search

CPC ..... B67B 7/28; B65D 37/00; B65D 17/00; B65D 2585/005; B65D 35/28; B65D 77/06

USPC ..... 222/80–91, 92–107

See application file for complete search history.

(56) References Cited

U.S. PATENT DOCUMENTS

| | | | | |
|---|---|---|---|---|
| 4,724,982 | A | 2/1988 | Redmond | |
| 5,431,304 | A * | 7/1995 | Gentile | 222/103 |
| 5,494,192 | A | 2/1996 | Redmond | |
| 6,007,264 | A | 12/1999 | Koptis | |

(Continued)

FOREIGN PATENT DOCUMENTS

| | | | |
|---|---|---|---|
| BR | PI0804671 | A2 | 3/2011 |
| EP | 0407320 | A1 | 1/1991 |
| GB | 2463947 | A | 4/2010 |
| WO | 2010080049 | A1 | 7/2010 |

OTHER PUBLICATIONS

Meridian Home Products, Inc., Punch 'N Skweez Ketchup Packet Opener, http://www.meridianhomeproducts.com/products/Punch-%27n-Skweez-Ketchup-packet-Opener-4-Pack.html (accessed Oct. 12, 2012).

(Continued)

*Primary Examiner* — Lien Ngo

(74) *Attorney, Agent, or Firm* — Barlow, Josephs & Holmes, Ltd.

(57) ABSTRACT

A device for opening a sealed flexible packet and for dispensing its contents has a flexible body that allows a user to dispense a product from a sealed packet with the use of only one hand. The device has a body with a flexible a flexible outer wall defining a slot into which a user can place a sealed packet. The inner surface of the body has blades that pierce the packet when the body is squeezed around the packet. Further squeezing of the body causes the contents of the packet to be dispensed through openings in the body. The body is spring biased to a position to facilitate loading a packet, unloading the packet after dispensing the product, and replacing it with a sealed packet, all with the use of only one hand. Tabs at the end of the body help keep it upright during loading and unloading.

7 Claims, 3 Drawing Sheets

(56) References Cited

U.S. PATENT DOCUMENTS

| | | | | |
|---|---|---|---|---|
| 6,263,772 | B1 | 7/2001 | Navot et al. | |
| 6,443,307 | B1 | 9/2002 | Burridge | |
| 6,488,428 | B1 | 12/2002 | Fischer | |
| 6,508,604 | B1 | 1/2003 | Bechmann et al. | |
| 6,634,523 | B2 | 10/2003 | Slewidge | |
| 6,945,391 | B2 | 9/2005 | Moodie | |
| 7,086,110 | B2 * | 8/2006 | Aouad | 8/159 |
| 7,340,790 | B2 * | 3/2008 | Aouad et al. | 8/158 |
| 7,445,643 | B2 * | 11/2008 | Sadlowski et al. | 8/137 |
| 7,506,762 | B2 | 3/2009 | Nelson et al. | |
| 7,552,823 | B2 | 6/2009 | Schuehrer | |
| D623,074 | S | 9/2010 | Caldwell et al. | |
| 7,987,985 | B2 | 8/2011 | Ede et al. | |
| 8,028,837 | B2 | 10/2011 | Gerstle et al. | |
| 8,205,771 | B2 * | 6/2012 | Compton | 222/105 |
| 2007/0138204 | A1 | 6/2007 | Chen et al. | |
| 2010/0083794 | A1 | 4/2010 | Galpin | |
| 2010/0254637 | A1 | 10/2010 | Lesko | |
| 2012/0223099 | A1 | 9/2012 | Sanchez | |

OTHER PUBLICATIONS

Khort, Khort Packet Cutter, http://inpama.com/index.php?content-invention&id=299 (accessed Oct. 12, 2012).

Drinkstuff, Quick Snip Sachet Opener, http://www.drinkstuff.com/products/product.asp?ID=7156 (accessed Oct. 12, 2012).

Alibaba.com, Opener Ketchup, http://www.alibaba.com/product-free/113198926/Opener_ketchup.html (accessed Oct. 12, 2012).

Heniz, Dip and Squeeze, http://www.heinzketchup.com/Dip-and-Squeeze/locator/ (accessed Oct. 12, 2012).

* cited by examiner

DEVICE FOR OPENING AND DISPENSING CONTENTS OF PACKETS

CROSS-REFERENCE TO RELATED APPLICATIONS

This application is related to and claims priority from earlier filed U.S. Provisional Patent Application No. 61/668,586, filed Jul. 6, 2012, the entire contents of which are incorporated herein by reference.

BACKGROUND OF THE INVENTION

The present invention relates to a device that assists in opening sealed packets and assists in dispensing the contents thereof. More specifically, the present invention relates to a device that facilitates a one-handed operation for the opening and dispensing of the contents from a sealed packet containing comestibles or other substances. An inventor's disclosure is attached which illustrates the present invention.

Sealed bag-like, flexible packets containing pourable substances are widely used in the foodservice, medical, and other industries. Such packets may contain comestible substances, such as ketchup, mustard, mayonnaise, various types of sauces in foodservice, or other types of substances, e.g., adhesives, ointments, medicines, sealing materials and the like. In order to preserve the substances contained in the packets for a long period of time (long shelf life), the packets are usually made of air-tight multi-ply materials such as foil and plastic. While the packets are indeed effective in preserving their contents in good condition for an extended period of time and are mechanically strong, the user often has a difficult time in opening the packets.

To facilitate opening such packets, often there is a notch or cut provided at one edge of a packet that provides a weakened region that assists in the task of opening the packet. In such an arrangement a user tears along the notch or cut, however, such an operation more often than not, results in spilling, or worse, spraying the surroundings with the contents thereof, and requires the use of two hands in the opening operation.

The difficulty arises in that the use of such sealed, bag-like flexible packets is fairly commonplace for use in dispensing comestible or other substances is prevalent in the foodservice industry, as well as others. While the packets have efficiencies in their convenience and easy storage, opening and dispensing of such products presents its own challenges. Still further, individuals who are disabled and lack strength or motor dexterity in both of their hands face even greater difficulty in opening such packets. As a result, the need exists for a one-handed opening device for said packets.

SUMMARY OF THE INVENTION

In accordance with the present invention a device that assists in the one handed opening of sealed packets and assisting in dispensing the contents thereof is provided. The broad object of this present invention is to open and dispense these packets in a way operable with only one hand. In operation, the device of the present invention allows for the packet to be easily inserted into the device while the device sits stable, on its own accord, on or against a flat surface. The device is then lifted and operated with one hand, employing a squeezing action to puncture the packet, and then dispensing it in a more controlled manner.

As can be seen in the invention disclosure, a device is provided for effecting opening of a flexible rectangular, pillow-like, sealed flexible packet having a length, a width and a thickness dimensions, and for dispensing pourable contents therefrom using only one hand. The device includes a body having a stiff but flexible lower plane and includes an inner surface and an outer surface configured to receive and retain one of the packets. The lower plane has side walls forming a slot opening in which a user may easily insert a packet. The end opposite the slot includes a piercing or cutting means. The piercing or cutting means preferably includes at least one blade that projects on the interior of the slot. The device is preferably configured such that the packet may be inserted directly into the slot while the device is stable and stationary on or against a flat plane, with no other means necessary to open or close said device.

In operation, squeezing the packet and urging it in a forward motion along the inner surface is operative both to bring the packet into contact with the blade to form an opening in the packet by compressing the packet to form a bulge to pressurize or push the packet against the blade and thus in turn to dispense the contents of the packet through the opening in said packet.

In a preferred embodiment, the outer surface of the outer wall of the device is shaped in a convex manner in order to develop a spring action that keeps the device open prior to insertion of the packet, as well as to promote retraction of the device surface after initial cutting. When the device is squeezed, the surfaces contract to one another aiding in an upper, above the blade, secondary squeeze if needed for full dispensing. The secondary squeeze of the combined device and now cut packet creates a pressure in the direction of the packet opening and aligned dispenser opening of the device which will further aid in dispensing the contents of the packet. The advantage is that it allows the packet to be opened and the contents to be dispensed without contacting the hands of the user. It also directs the dispensing contents in a controlled manner. In this instance both the device and the empty packet may be disposed of together, or the packet may be removed and the device reused.

Obviously, many modifications and variations of the present invention are possible in light of the above teachings. It is, therefore, to be understood that within the scope of the present application, the present invention may be practiced otherwise than as specifically described.

DESCRIPTION OF THE DRAWINGS

In the drawings which illustrate the best mode presently contemplated of carrying out the present invention.

DESCRIPTION OF THE PREFERRED EMBODIMENT

Figure 2:
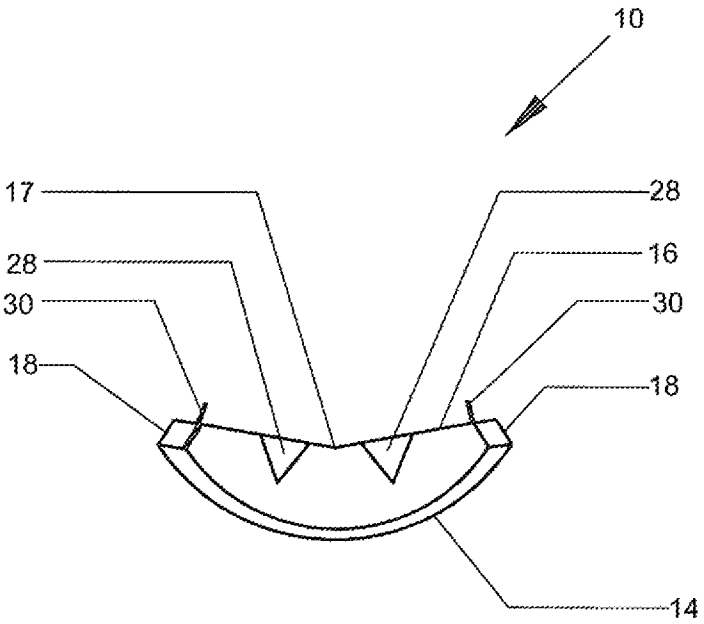
FIG. 2 is a top view thereof.

Referring now to the drawings, the dispensing device of the instant invention is illustrated and generally indicated at 10 in FIGS. 1-6. As will hereinafter be more fully described, the instant dispensing device enables a user to open a sealed packet and dispense a product from the packet with the use of only one hand.

The dispensing device of the present invention has a body that is open at either end and has a flexible outer wall defining a slot into which a sealed packet may be placed. The flexible outer wall has an inner surface and an outer surface. Blades formed on the inner surface allow the user to squeeze the dispensing device to puncture a packet and then dispense a product therefrom through an opening in the second end of the body.

In one embodiment, the body 12 is formed with a flexible outer wall that is made up of a front wall 14, a rear wall 16, and two side walls 18 connecting the front wall 14 to the rear wall 16. The outer wall defines a slot, and the upper end 20 of the body 12 is open so that a flexible packet 24 containing a dispensable product 26 may be inserted in the slot. The lower end 22 of the body is also open so that a product may be dispensed from the packet 24, as described below.

Figure 1:
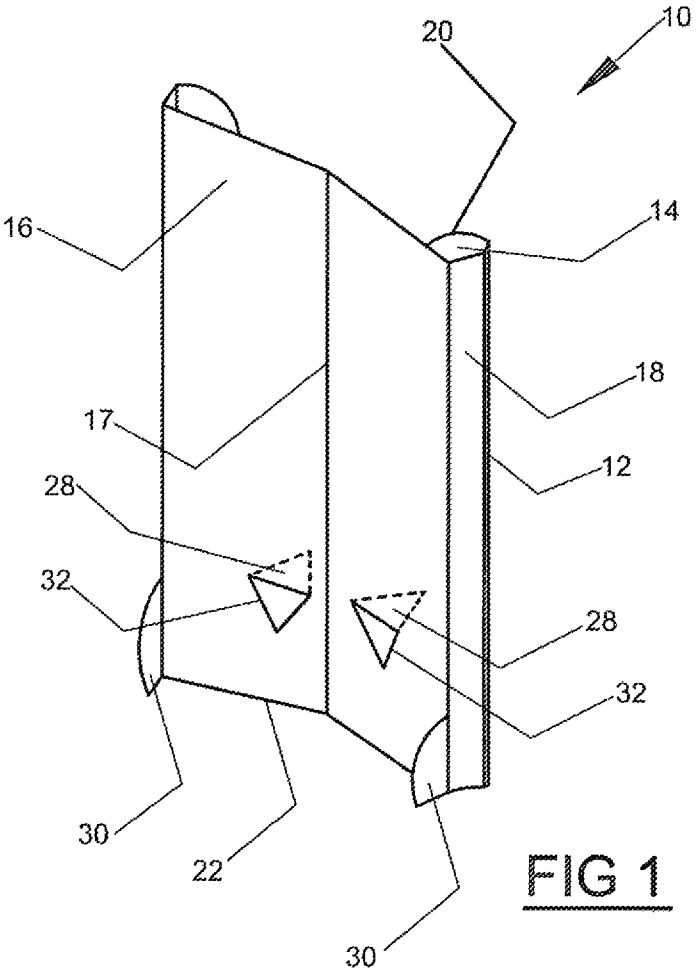
FIG. 1 is a rear perspective view of the dispensing device of the present invention.

FIG. 1 shows a perspective view of the dispensing device 10 as it would be provided to a consumer. The dispensing device 10 is initially empty, and may be provided separately from or together with a sealed packet 24 containing a dispensable product 26.

When ready to open a sealed packet 24, the consumer sets down the dispensing device 10 on a table surface so that the lower surface of its lower end 22 is in facing engagement with the table or resisting surface. Tabs 30 extending from the lower end 22 of the device 10 increase the stability of the device 10, so that it is less likely to tip over due to wind, vibration of the table or resisting/opposing surface, or other external forces.

In FIG. 1, the tabs 30, or similarly shaped formations to provide stability, are located where the back wall 16 meets each of the side walls 18. FIG. 2 shows how the tabs extend rearwardly from the rear wall. More or fewer tabs may be used without departing from the scope of the present invention. The tabs 30 may be formed integrally with the body 12, or they may be formed separately from the body and then secured to the body.

Figure 3B:
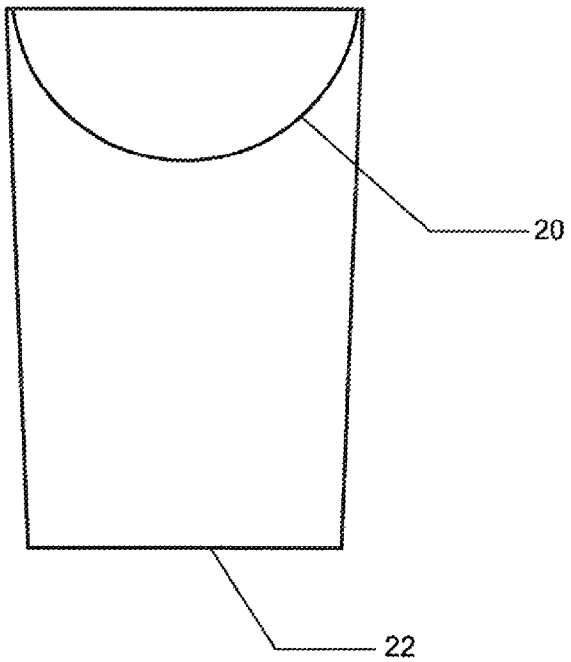
FIG. 3B is a front view thereof.
Figure 3A:
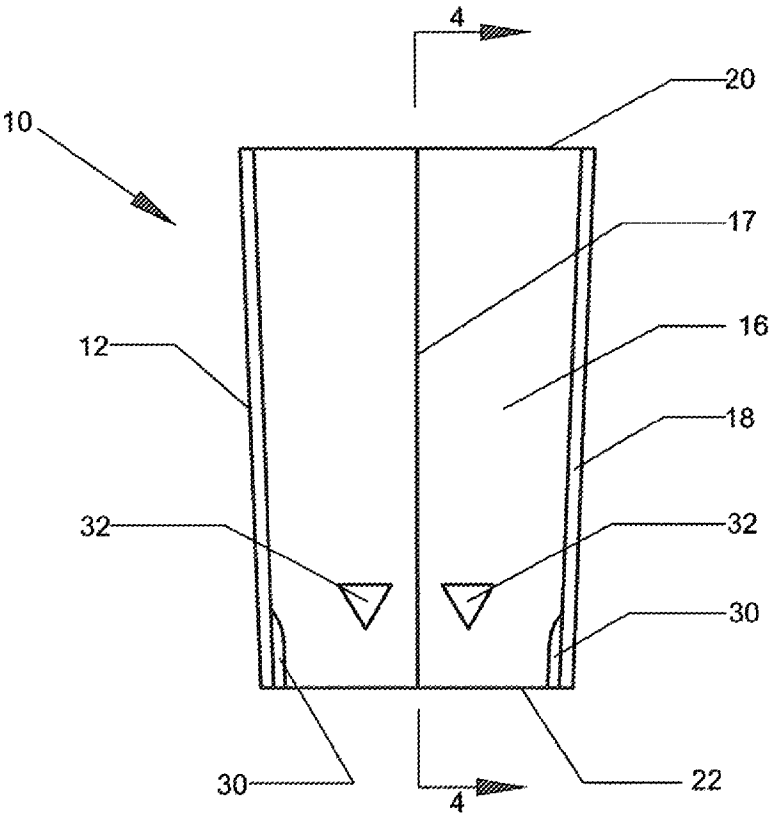
FIG. 3A is a rear view thereof.

FIG. 2 also shows the rear wall 16 in the form of a stiff but flexible and possibly folded plane, with a vertical crease 17, which is also visible in FIG. 3. The front wall 14 in FIG. 2 is shaped in a convex manner that provides a spring bias to keep the slot of the device open prior to insertion of the packet, as well as to promote retraction of the walls of the device when the user is ready to suspend dispensing of the product or to remove an empty packet from the device.

Figure 5:
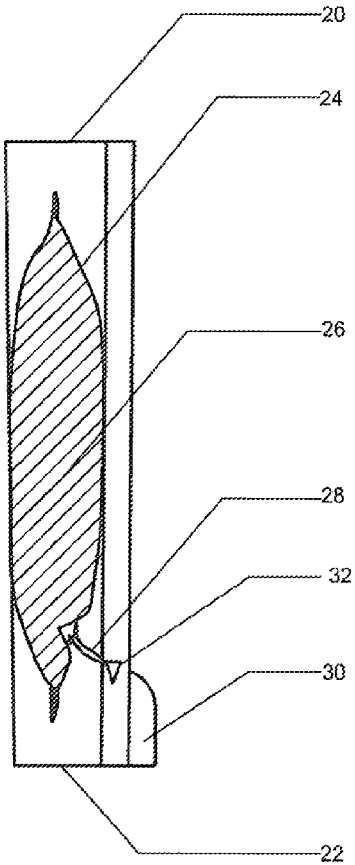
FIG. 5 is a side view thereof showing the a packet pierced by a blade.
Figure 4:
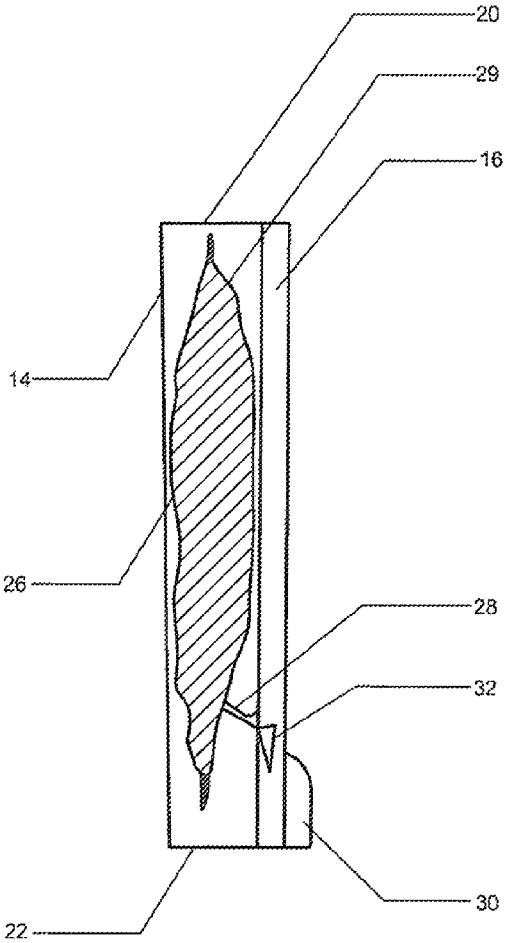
FIG. 4 is a side view thereof showing a sealed packet inserted in slot.

Then the user picks up a sealed packet and inserts it into the upper end 20 of the body 12, into the slot defined by the outer wall. The upper end 20 of front wall 14 is curved or cut out to provide a larger opening to ease placement or insertion of the packet. When the packet 24 is fully inserted in the body 12, it rests against the inner surface of the body, as shown in FIG. 4. In the embodiment of FIGS. 1-6, the inner surface is substantially smooth, except for blades 28 extending inwardly from the inner surface. These blades 28 on the inner surface of the outer wall of the dispensing device allow the user to open the packet by simply squeezing the outer wall inwardly against the packet. FIG. 5 shows how the front wall 14 and rear wall 16 may be squeezed together so that the blades 28 pierce the packet 24.

Figure 6:
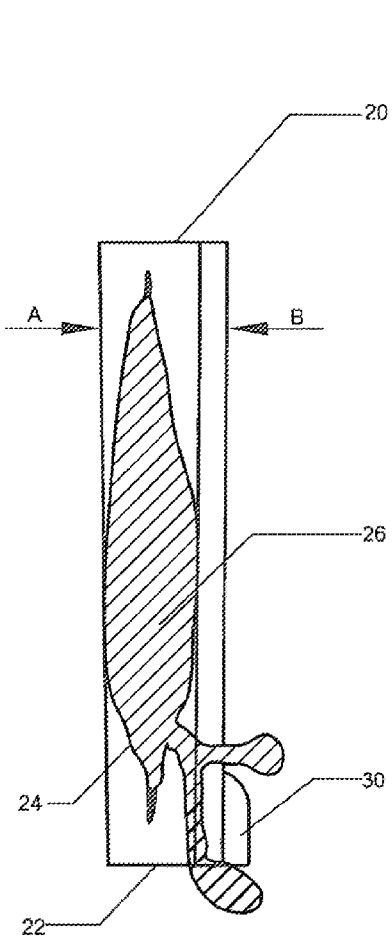
FIG. 6 is a side view thereof showing the product being dispensed from the packet.

Further squeezing of the front wall 14 and rear wall 16 causes the product to be dispensed from the packet 24. FIG. 6 shows a cross sectional view of the dispensing device rotated horizontally when a user applies a secondary squeeze to the front and rear walls. Squeezing the front wall and rear wall towards the upper end 20 of the body 12, so that the front wall 14 is deflected in direction A and rear wall 16 is deflected in direction B, causes the product 26 in the packet 24 to be urged towards the lower end 22 of the dispensing device. This secondary squeeze helps to push or further bulge or repressurize the contents in direction C, and then out of the packet and out of the dispensing device 10. The product may exit the body 12 through the dispensing openings, or holes, 32 in the rear wall 16, or through the open lower end 22 of the body 12, as shown in FIG. 6.

The dispensing device 10 of the present invention is designed to be slightly larger than the packet to be dispensed, but not so large that it cannot be easily handled with one hand. The dispensing device may be made out of plastic so that it is both flexible and lightweight.

The design of the dispensing device makes it easy to manipulate, while still providing a clean and safe device. Because of the solid construction of the dispensing device and the spring bias of the outer wall, the user does not need to assemble the dispensing device around a packet. Furthermore, the opening and dispensing steps of FIGS. 5 and 6 can be easily performed in a continuous squeezing motion. Sharp blades 28 on the inner surface of the outer wall reduce the squeezing force required to puncture a packet 24.

In addition, the walls 14, 16, 18 shield the user's hands from the dispensed product. When using the dispensing device of the present invention, the dispensed product is directed out of the holes 32 in the rear wall 16 and out of the open lower end 22 of the body 12, while the user's fingers are shielded from the condiment.

The design of the dispensing device 10 makes it comfortable and easy to use. The convex front wall 14 and concave rear wall 16 of FIGS. 1-6 provide an overall contour of the dispensing device 10 so that it is comfortably held in one hand. For example, the user's thumb may be placed against the rear wall 16 and the user's index and middle fingers may be placed against the front wall 14. The rear wall 16 is substantially trapezoidal, as shown in FIG. 2. Because of this trapezoidal rear wall 16, the body 12 has a wider upper end 20, which facilitates single-handed insertion of a packet 24 into the slot defined by the walls 14, 16, 18 while still ensuring proper alignment of the lower end of the packet 24 with the blades 28.

Although the present embodiment shows two blades 28, some embodiments may include one blade or more than two blades, without departing from the scope of the present invention.

Additionally, the location of the blades 28 may be changed without departing from the scope of the present invention. For example, the blades and holes could be placed on the front wall 14 or a side wall 18, depending on user preferences of the dispensing direction.

The blades may be integrally formed with the body 12 or they may be formed separately from the body and then secured to the body. In the present embodiment, the blades are formed by cutting two sides of a triangle in the rear wall, and then folding the two triangles upwards. This simultaneously forms the blades 28 and the dispensing openings, or holes, 32 on the rear wall 16. This method is particularly advantageous because the dispensing holes 32 are adjacent to the blades 28. Thus, the dispensable product has a more direct path out of the body 12. This helps keep the inner surface of the body clean, which is particularly beneficial when the user desires to reuse the dispensing device for another packet.

It can therefore be seen that the present invention provides a dispensing device that facilitates single-handed opening and dispensing of packets. The present invention is particularly useful for individuals who are disabled or lack sufficient strength or motor dexterity to open packets with their hands alone. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for effecting opening of a rectangular sealed flexible packet, said device being configured for dispensing pourable contents therefrom using only one hand, said device comprising:

a body having a flexible outer wall, said outer wall further comprising a front wall and a rear wall, said body having a first open end and a second open end;

said outer wall defining a slot between said front wall and said rear wall;

said front wall and rear wall being connected so that said body laterally encircles said slot, said body being biased to a first configuration in which said front and rear walls are spaced apart for slidably receiving a packet into said slot, wherein a sealed flexible packet may be placed through said first end of said body and into said slot while said device is stable and stationary on a flat plane when said body is in said first configuration; and at least one blade located on said body near said second end and projecting inwardly so that said at least one blade is capable of puncturing a packet that has been placed within said body;

wherein flexing said outer wall by forcing at least a portion of said front wall towards said rear wall causes said at least one blade to puncture said packet, said body being capable of being flexed further to dispense pourable contents from said packet.

2. The device of claim 1, wherein said at least one blade is located on said rear wall near said second end and projects inwardly so that said at least one blade is capable of puncturing a packet that has been placed within said slot when said front wall and said rear wall are squeezed together around said packet.

3. The device of claim 1, wherein at least one tab extends outwardly from said body at said second end, so that when said second end of said body is placed on a substantially flat surface, said second end of said body and a lower surface of said at least one tab are in facing engagement with said flat surface, thereby increasing the stability of said device.

4. The device of claim 1, wherein said rear wall is substantially trapezoidal.

5. The device of claim 2, wherein said at least one blade comprises two blades.

6. The device of claim 1, wherein said rear wall further comprises at least one hole located near said at least one blade, through which a product may be dispensed; and further wherein said front wall provides a continuous surface so that a product may not be dispensed therethrough.

7. The device of claim 1, wherein said at least one blade is integrally formed with said rear wall.

* * * * *